US011401748B2

(12) United States Patent
Kontras

(10) Patent No.: US 11,401,748 B2
(45) Date of Patent: Aug. 2, 2022

(54) SHROUDED SCREW DEVICE FOR REMOVING AND DEPOSITING MATERIAL

(71) Applicant: Honeywell Federal Manufacturing & Technologies, LLC, Kansas City, MO (US)

(72) Inventor: Evan A. Kontras, Kansas City, MO (US)

(73) Assignee: Honeywell Federal Manufacturing & Technologies, LLC

( * ) Notice: Subject to any disclaimer, the term of this patent is extended or adjusted under 35 U.S.C. 154(b) by 0 days.

(21) Appl. No.: 17/118,109

(22) Filed: Dec. 10, 2020

(65) Prior Publication Data

US 2022/0186565 A1 Jun. 16, 2022

(51) Int. Cl.

| | |
|---|---|
| ***E21B 10/22*** | (2006.01) |
| ***E21B 10/62*** | (2006.01) |
| ***E21B 10/44*** | (2006.01) |
| ***E21B 17/07*** | (2006.01) |

(52) U.S. Cl.

CPC ..... *E21B 10/22* (2013.01); *E21B 10/44* (2013.01); *E21B 10/62* (2013.01); *E21B 17/07* (2013.01)

(58) Field of Classification Search

CPC ..... E21B 17/07; E21B 17/076; E21B 10/44

See application file for complete search history.

(56) References Cited

U.S. PATENT DOCUMENTS 1,644,426 A * 10/1927 Gentsch ..... A01B 1/16 175/170
1,927,871 A * 9/1933 Irwin ..... G01N 1/04 175/323
2,250,670 A * 7/1941 Joy ..... E21B 10/44 175/323
2,385,441 A * 9/1945 Hill ..... A01B 1/00 175/394
2,735,703 A * 2/1956 Goodman ..... E21B 27/04 175/388
3,447,381 A * 6/1969 Clark ..... G01N 1/08 73/864.43
3,565,190 A * 2/1971 Ishii ..... E21B 7/002 175/323
4,228,862 A * 10/1980 Causse ..... E21B 7/002 175/242
4,488,605 A * 12/1984 Ruppel ..... E21B 7/008 175/18

(Continued)

*Primary Examiner* — Blake Michener

(74) *Attorney, Agent, or Firm* — Hovey Williams LLP

(57) ABSTRACT

A shrouded screw apparatus includes an outer tube, a telescoping inner tube, an auger bit, and an anti-rotation pin. The outer tube has a first sidewall defining a first interior chamber. The first sidewall has an opening defined therethrough. The inner tube is positioned in the first interior chamber. The inner tube has a second sidewall defining a second interior chamber. The second sidewall has a longitudinal groove defined therein. The inner tube is configured to extend from and retract within the first interior chamber of the outer tube. The auger bit is positioned in the second interior chamber and is rotatably coupled to the inner tube. The anti-rotation pin is coupled to the first sidewall of the outer tube and extends inwardly into the first interior chamber. The pin engages the longitudinal groove of the inner tube.

17 Claims, 16 Drawing Sheets

(56) References Cited

U.S. PATENT DOCUMENTS

| | | | | |
|---|---|---|---|---|
| 4,877,091 | A * | 10/1989 | Howell, Jr. | E21B 19/086 173/141 |
| 5,245,878 | A | 9/1993 | Underwood | |
| 6,145,600 | A | 11/2000 | Dickinson | |
| 10,309,160 | B1 | 6/2019 | Goren | |
| 10,781,637 | B1 * | 9/2020 | Hall | E21B 7/006 |
| 2010/0074702 | A1 * | 3/2010 | Kluge | A01K 97/01 408/125 |
| 2019/0250072 | A1 | 8/2019 | Pasch | |

* cited by examiner

SHROUDED SCREW DEVICE FOR REMOVING AND DEPOSITING MATERIAL

STATEMENT REGARDING FEDERALLY SPONSORED RESEARCH OR DEVELOPMENT

This invention was made with Government support under Contract No.: DE-NA-0002839 awarded by the United States Department of Energy. The Government has certain rights in the invention.

FIELD OF THE DISCLOSURE

The embodiments described herein relate generally to an apparatus for implanting objects or materials within other materials, and more particularly, to a portable apparatus for efficiently removing a portion of material, implanting an object, and depositing the removed material over the object.

BACKGROUND

Implanting large quantities of objects or material into another material can be laborious, inefficient, messy, and costly. Typically, a large number of holes or bores must be drilled or dug into the material. Typical auger bits designed for bore holes, for example, in soil, generally lift the soil upward out of the bore and dispense it radially about the bore hole. Some known auger bits are encased and contain the extracted soil within the casing. However, the auger bit must be withdrawn from the bore hole before implanting an object and/or material.

SUMMARY

This summary is provided to introduce a selection of concepts in a simplified form that are further described in the detailed description below. This summary is not intended to identify key features or essential features of the claimed subject matter, nor is it intended to be used to limit the scope of the claimed subject matter. Other aspects and advantages of the present disclosure will be apparent from the following detailed description of the embodiments and the accompanying drawing figures.

In one aspect, an apparatus is provided. The apparatus includes an outer tube having a first sidewall defining a first interior chamber. The sidewall has an opening defined therethrough. The apparatus also includes an inner tube positioned in the first interior chamber. The inner tube has a second sidewall defining a second interior chamber. The second sidewall has a longitudinal groove defined therein. The inner tube is configured to extend from and retract within the first interior chamber of the outer tube. Furthermore, the apparatus includes an auger bit positioned in the second interior chamber. The auger bit rotatably coupled to the inner tube. Moreover, the apparatus includes an anti-rotation pin coupled to the first sidewall of the outer tube. The anti-rotation pin extends inwardly into the first interior chamber and engages the longitudinal groove of the inner tube. As the inner tube extends from and retracts within the first interior chamber, the inner tube is prevented from rotating with respect to the outer tube.

In another aspect, a method is provided. The method includes positioning an inner shaft collar along a shaft of an auger bit to locate a cutting tip of the auger bit relative to an inner tube of a shrouded screw apparatus. The shrouded screw apparatus includes an outer tube having an opening defined therethrough. The inner tube is positioned within the outer tube and has a bearing cap coupled thereto. The bearing cap includes a bearing. The method also includes inserting the auger bit into an inner chamber of the inner tube, passing a shaft of the auger bit through the bearing of the bearing cap until the inner shaft collar contacts the bearing. Furthermore, the method includes coupling an outer shaft collar to the shaft of the auger bit. The outer shaft collar is positioned against the bearing. The method includes placing the shrouded screw apparatus against a substrate material at a position for a bore hole and activating a torque producing means to rotate the auger bit. Rotating the auger bit draws extracted material into the inner chamber of the inner tube and draws the shrouded screw apparatus into the substrate material. The method also includes extending the inner tube telescopically relative to the outer tube, depositing an object into the bore hole through the opening, and reversing the rotation direction of the auger bit to deposit the extracted material into the bore hole.

Advantages of these and other embodiments will become more apparent to those skilled in the art from the following description of the exemplary embodiments which have been shown and described by way of illustration. As will be realized, the present embodiments described herein may be capable of other and different embodiments, and their details are capable of modification in various respects. Accordingly, the drawings and description are to be regarded as illustrative in nature and not as restrictive.

BRIEF DESCRIPTION OF THE DRAWINGS

The Figures described below depict various aspects of systems and methods disclosed therein. It should be understood that each figure depicts an embodiment of a particular aspect of the disclosed systems and methods, and that each of the figures is intended to accord with a possible embodiment thereof. Further, wherever possible, the following description refers to the reference numerals included in the following figures, in which features depicted in multiple figures are designated with consistent reference numerals.

Figure 1:
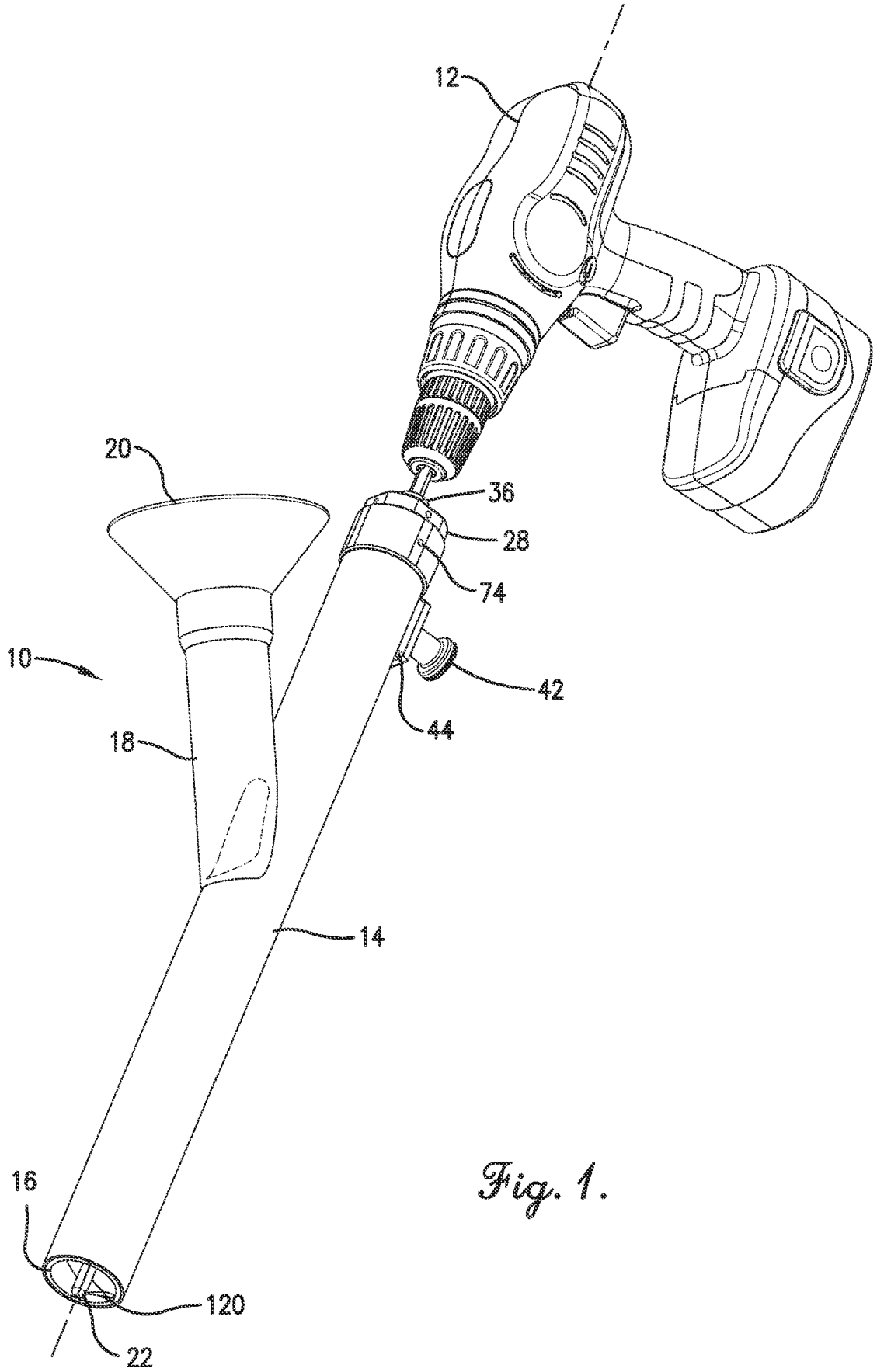
FIG. 1 is a forward perspective view of an exemplary shrouded screw apparatus coupled to a torque producing means, in accordance with one aspect of the present invention.

Unless otherwise indicated, the drawings provided herein are meant to illustrate features of embodiments of this disclosure. These features are believed to be applicable in a wide variety of systems comprising one or more embodiments of this disclosure. As such, the drawings are not meant to include all conventional features known by those of ordinary skill in the art to be required for the practice of the embodiments disclosed herein.

DETAILED DESCRIPTION

The following detailed description of embodiments of the disclosure references the accompanying figures. The embodiments are intended to describe aspects of the disclosure in sufficient detail to enable those with ordinary skill in the art to practice the disclosure. The embodiments of the disclosure are illustrated by way of example and not by way of limitation. Other embodiments may be utilized, and changes may be made without departing from the scope of the claims. The following description is, therefore, not limiting. The scope of the present disclosure is defined only by the appended claims, along with the full scope of equivalents to which such claims are entitled.

In this description, references to "one embodiment," "an embodiment," or "embodiments" mean that the feature or features being referred to are included in at least one embodiment of the technology. Separate references to "one embodiment," "an embodiment," or "embodiments" in this description do not necessarily refer to the same embodiment and are also not mutually exclusive unless so stated and/or except as will be clear to those skilled in the art from the description. For example, a feature, structure, act, etc. described in one embodiment may also be included in other embodiments but is not necessarily included. Thus, the present technology can include a variety of combinations and/or integrations of the embodiments described herein.

In the following specification and the claims, reference will be made to several terms, which shall be defined to have the following meanings. The singular forms "a," "an," and "the" include plural references unless the context clearly dictates otherwise. "Optional" or "optionally" means that the subsequently described event or circumstance may or may not occur, and that the description includes instances where the event occurs and instances where it does not.

Approximating language, as used herein throughout the specification and the claims, may be applied to modify any quantitative representation that could permissibly vary without resulting in a change in the basic function to which it is related. Accordingly, a value modified by a term or terms, such as "about," "approximately," and "substantially" are not to be limited to the precise value specified. In at least some instances, the approximating language may correspond to the precision of an instrument for measuring the value. Here and throughout the specification and claims, range limitations may be combined and/or interchanged, such ranges are identified and include all the sub-ranges contained therein unless context or language indicates otherwise.

As used herein, the terms "axial" and "axially" refer to directions and orientations extending substantially parallel to a longitudinal or rotational axis of the apparatus. The terms "radial" and "radially" refer to directions and orientations extending substantially perpendicular to the longitudinal or rotational axis. The terms "tangent" and "tangential" refer to the directions and orientations extending substantially perpendicular to a radial direction. In addition, as used herein, the terms "circumferential" and "circumferentially" refer to directions and orientations extending in the general direction around the longitudinal or rotational axis of the apparatus (such references not being limited to pure circular extension or to the periphery or outer perimeter of the object unless the context clearly indicates otherwise).

Moreover, directional references, such as, "top," "bottom," "front," "back," "side," and similar terms are used herein solely for convenience and should be understood only in relation to each other. For example, a component might in practice be oriented such that faces referred to herein as "top" and "bottom" are in practice sideways, angled, inverted, etc. relative to the chosen frame of reference.

Example Apparatus

Figure 2:
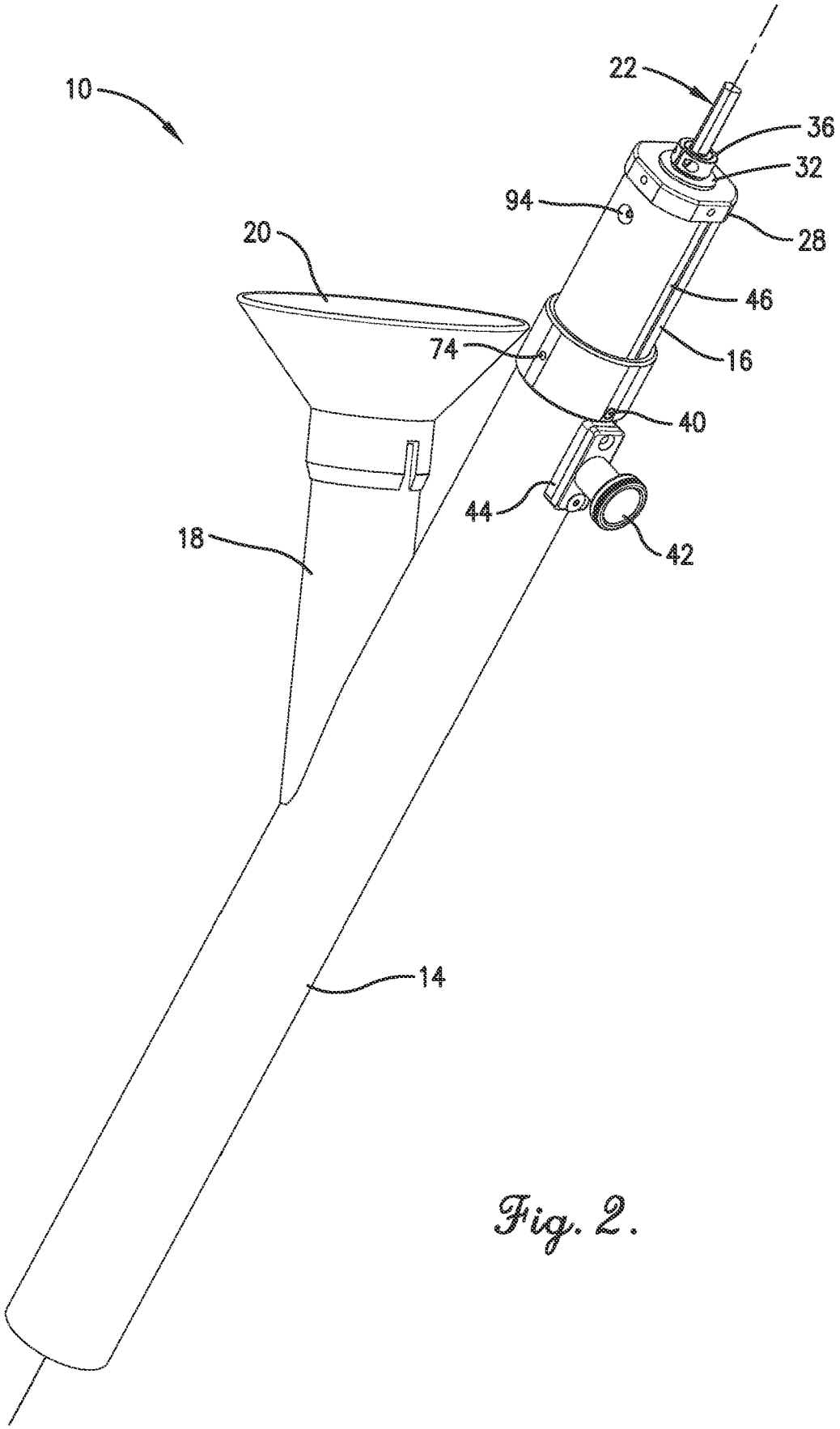
FIG. 2 is a rearward perspective view of the shrouded screw apparatus shown in FIG. 1.
Figure 3:
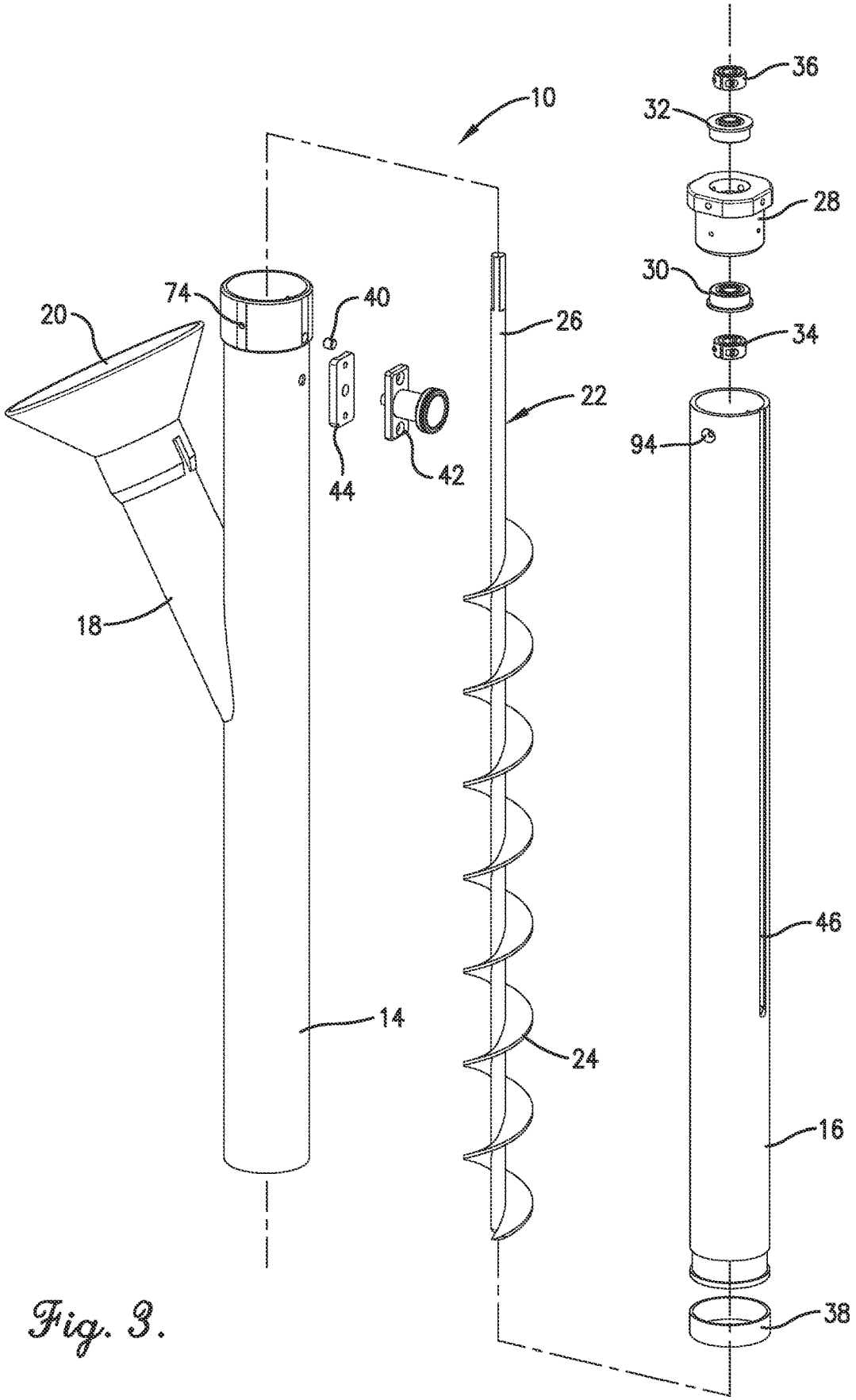
FIG. 3 is an exploded perspective view of the shrouded screw apparatus shown in FIG. 1.
Figure 4:
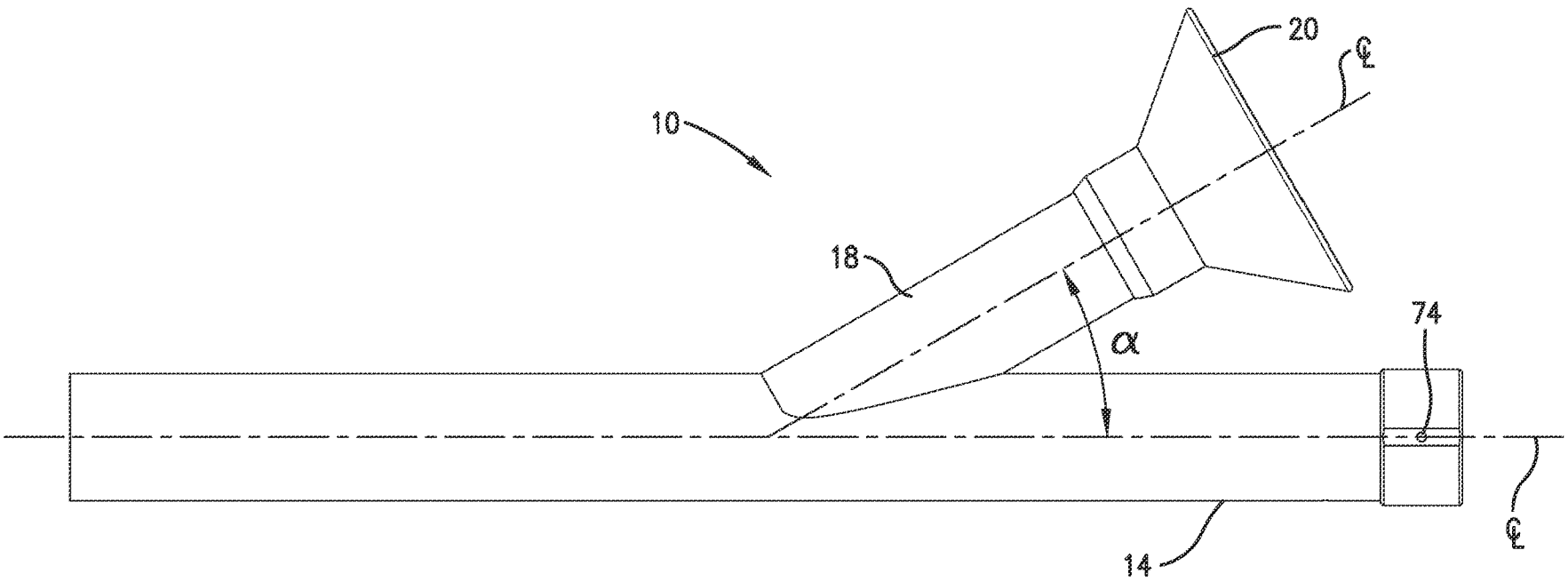
FIG. 4 is a side view of the shrouded screw apparatus shown in FIG. 1.

FIG. 1 is a forward perspective view of an exemplary shrouded screw apparatus 10 coupled to a torque producing means 12, in accordance with one aspect of the present invention. FIG. 2 is a rearward perspective view of the shrouded screw apparatus 10. FIG. 3 is an exploded perspective view of the shrouded screw apparatus 10. FIG. 4 is a side view of the shrouded screw apparatus 10. In the exemplary embodiment, the shrouded screw apparatus 10 includes an outer tube 14 and an inner tube 16, each defining a substantially hollow cylindrical body. The outer and inner tubes 14, 16 are telescopically engaged with one another. In particular, the engaged outer and inner tubes 14, 16 are slidable relative to one another between a contracted configuration (see, e.g., FIGS. 1 and 15) and an expanded configuration (see, e.g., FIG. 16).

The shrouded screw apparatus 10 also includes a depositing tube 18 having a proximal end coupled to the outer tube 14 and a receiving funnel 20 coupled to a distal end thereof. The depositing tube 18 defines a substantially hollow cylindrical body, and is configured to receive, in cooperation with the funnel 20, one or more objects or materials therethrough for transmission to the outer tube 14 via alignment with an opening defined therethrough. As depicted in FIG. 4, in one embodiment, the depositing tube 18 is oriented at a non-zero degree angle relative to the outer tube 14. In particular, a centerline (℄) of the depositing tube 18 intersects a centerline (℄) of the outer tube 14 at an angle $\alpha$ in the range between and including about twenty degrees (20°) and about forty degrees (40°). In a preferred embodiment, the depositing tube 18 is oriented at an angle $\alpha$ of about thirty degrees (30°). It is contemplated, however, that the depositing tube 18 may be oriented at any desirable angle $\alpha$ that enables the shrouded screw apparatus 10 to function as described herein. Furthermore, in certain embodiments, the shrouded screw apparatus 10 to not include the depositing tube 18 or funnel 20.

With reference back to FIGS. 1-3, the shrouded screw apparatus 10 also includes an auger bit 22. The auger bit 22 includes a helical blade or flight 24 extending axially along a shaft 26 of the auger bit 22. In the exemplary embodiment, the auger bit 22 is a single-flight auger. It is contemplated, however, that the auger bit 22 may be a double-flight or multi-flight auger bit. The number of flights (blades) and pitch of the flights may be determined, for example, based on the material into which the shrouded screw apparatus 10 is to be used. Typically, single-flight auger bits are an economical choice where material conditions are light and/or loose. Double-flighted auger bits are typically used to move material out of a bore quicker and/or where the material is heavier or denser.

The auger bit 22 is enclosed (or shrouded) within the inner tube 16. In particular, the auger bit 22 is inserted into the hollow cylindrical body of the inner tube 16 and rotatably coupled to a bearing cap 28. The bearing cap 28 includes two (2) bearings (an inner bearing 30 and outer bearing 32) for receiving an end portion of the auger bit shaft 26. The auger bit 22 is fixed in an axial position via two (2) shaft collars (an inner shaft collar 34 and outer shaft collar 36). The bearing cap 28 is fixedly coupled to an upper end of the inner tube 16. In the exemplary embodiment, the inner and outer bearings 30, 32 are ball bearing assemblies including a plurality of steel balls positioned between an inner and outer race. The outer races are coupled to the bearing cap 28. The inner races are coupled to the shaft 26 of the auger bit 22 and are configured to rotate relative to the outer races via the interposed steel balls. In alternative embodiments, the bearings 30, 32 can be any type of bearing and/or bearing assembly that enables the shrouded screw apparatus 10 to function as described herein, such as roller bearings, sleeve bearings, and the like.

At an end of the inner tube 16 opposite the bearing cap 28, the inner tube 16 includes a seal 38. The seal 38 is sized and shaped to engage the outer tube 14 as the inner tube 16 is telescopically moved relative to the outer tube 14. In one embodiment, the seal 38 is fabricated from a textile material, such as a non-woven felt. Alternatively, the seal 38 may be fabricated from any flexible resilient material that enables the shrouded screw apparatus 10 to function as described herein.

As further depicted in FIGS. 1-3, the shrouded screw apparatus 10 includes an anti-rotation pin 40, a spring plunger assembly 42, and a mounting plate 44, each coupled to the outer tube 14 adjacent an upper end thereof. As described further herein, the anti-rotation pin 40 and spring plunger assembly 42 are configured to extend into an interior chamber of the outer tube 14 and engage a groove 46 of the inner tube 16 to facilitate preventing rotation of the inner tube 16 relative to the outer tube 14 and locking the shrouded screw apparatus 10 in the expanded configuration depicted in FIG. 16.

As illustrated in FIGS. 1 and 2, the mounting plate 44 is coupled to the outer tube 14, for example, via an adhesive bond and/or welding technique. The mounting plate 44 includes an inner curved surface adjacent the outer tube 14 and an outer planar surface engaging the spring plunger assembly 42. In the exemplary embodiment, the spring plunger assembly 42 is coupled to the mounting plate 44, for example, with one or more mechanical fasteners, such as screws, bolts, rivets, and the like. It is contemplated, however, that the mounting plate 44 and the spring plunger assembly 42 may be attached to the respective components using any coupling techniques that enable the shrouded screw apparatus 10 to function as described herein.

In the exemplary embodiment, the depositing tube 18 and funnel 20 are fabricated from a suitably selected plastic material. For example, and without limitation, suitable materials from which the depositing tube 18 and funnel 20 may be fabricated include polyethylene, polypropylene, polyvinyl chloride, and the like. In other embodiments, the depositing tube 18 and funnel 20 may be fabricated from any material that enables the shrouded screw apparatus 10 to function as described herein, such as metals, resins, etc.

In one embodiment, the spring plunger assembly 42 is a plate-mount retractable spring plunger fabricated from steel. The spring plunger assembly 42 includes an extended nose that is biased outward via a spring-force. The nose engages the groove 46 of the inner tube 16 and, as described below, is used for locking and then locating the inner tube 16 relative to the outer tube 14. In the exemplary embodiment, the spring plunger assembly 42 includes two (2) holes in a plate that allows the plunger to be mounted to a flat surface, such as the mounting plate 44. The spring force exerted on the nose is in a range between and including about one and one-half pounds (1.5 lbs.) and about five and one-half pounds (5.5 lbs.). It is contemplated that the spring force may be selected to exert more or less force on the nose, as determined by the configuration and use of the shrouded screw apparatus 10.

Figure 5:
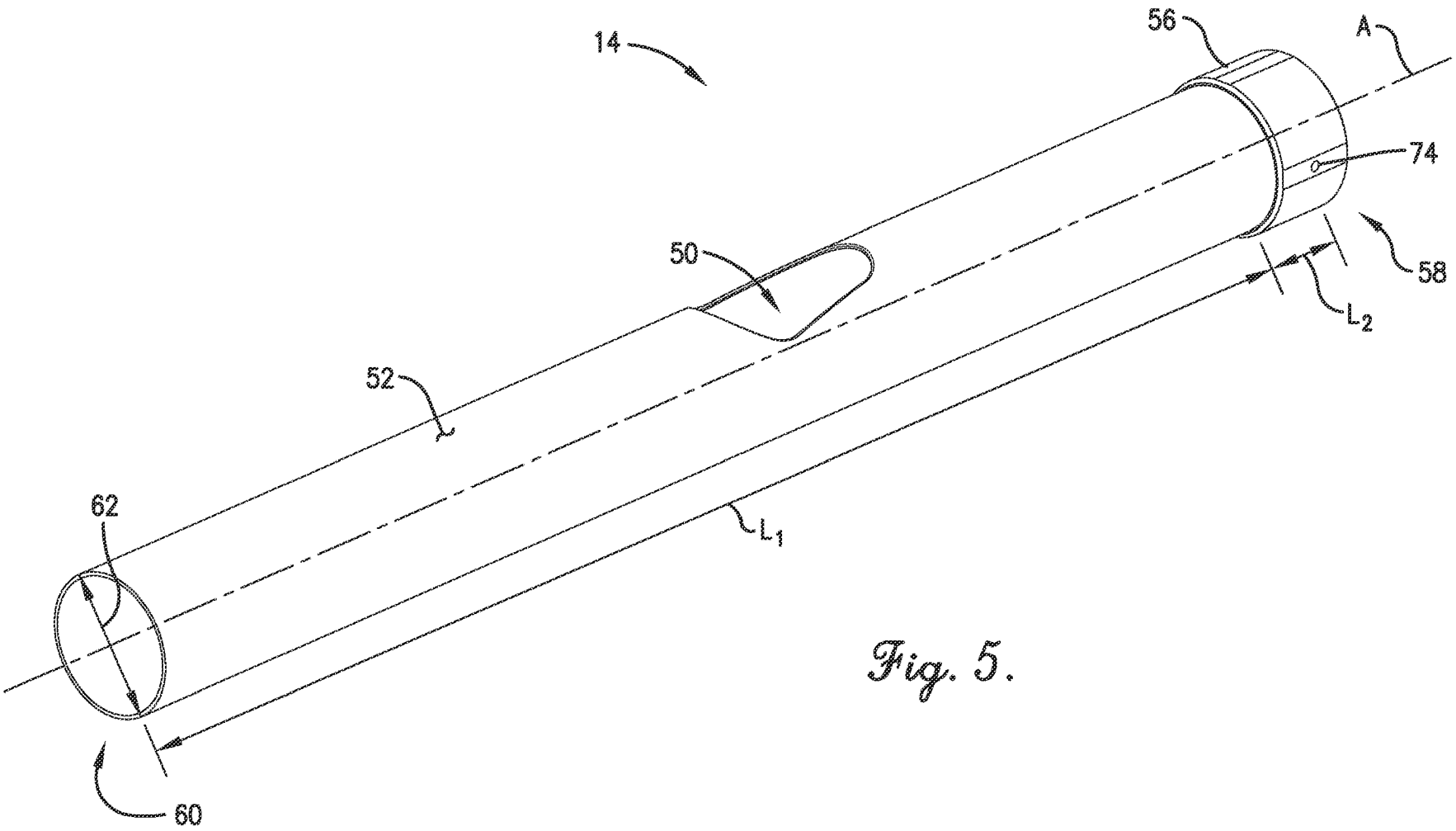
FIG. 5 is a perspective view of an outer tube of the apparatus shown in FIG. 1.
Figure 6:
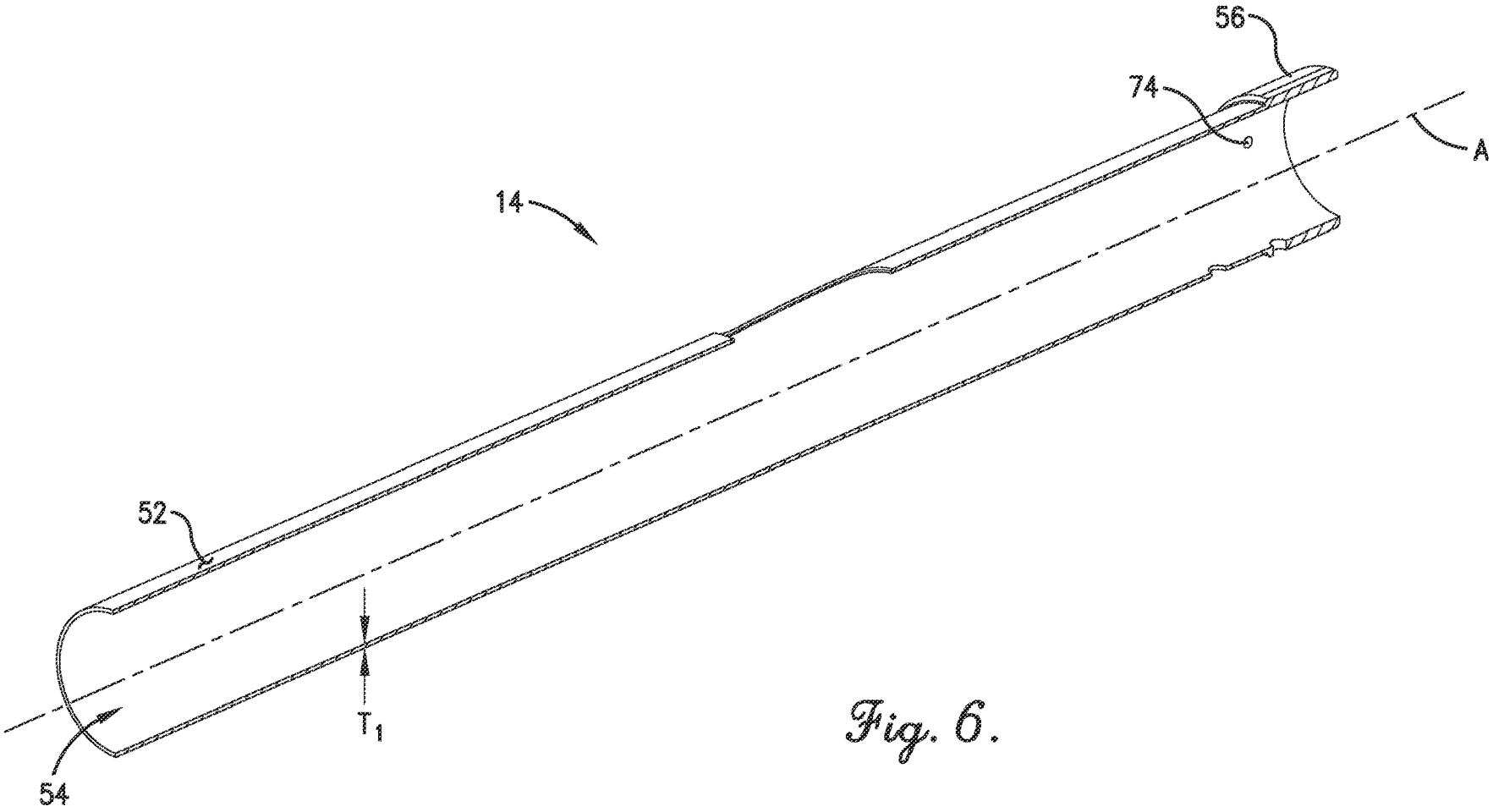
FIG. 6 is a sectional view of the outer tube shown in FIG. 5, taken along the longitudinal axis of the outer tube, as shown in FIG. 5.
Figure 7:
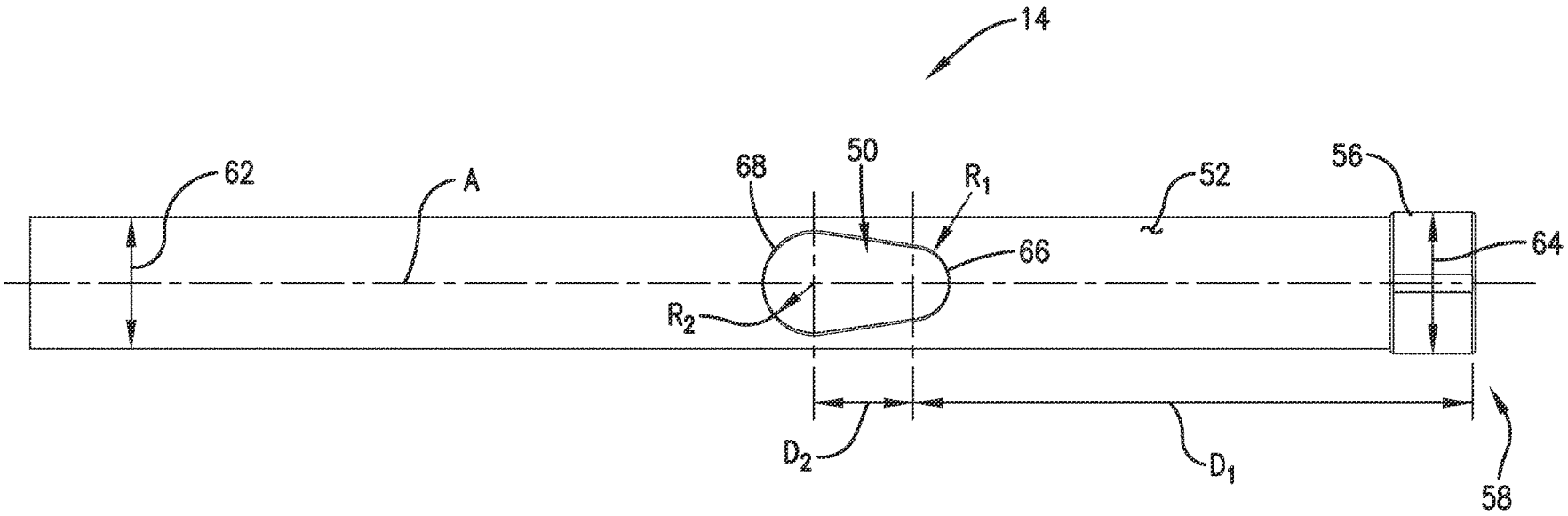
FIG. 7 is a top view of the outer tube shown in FIG. 5.
Figure 8:
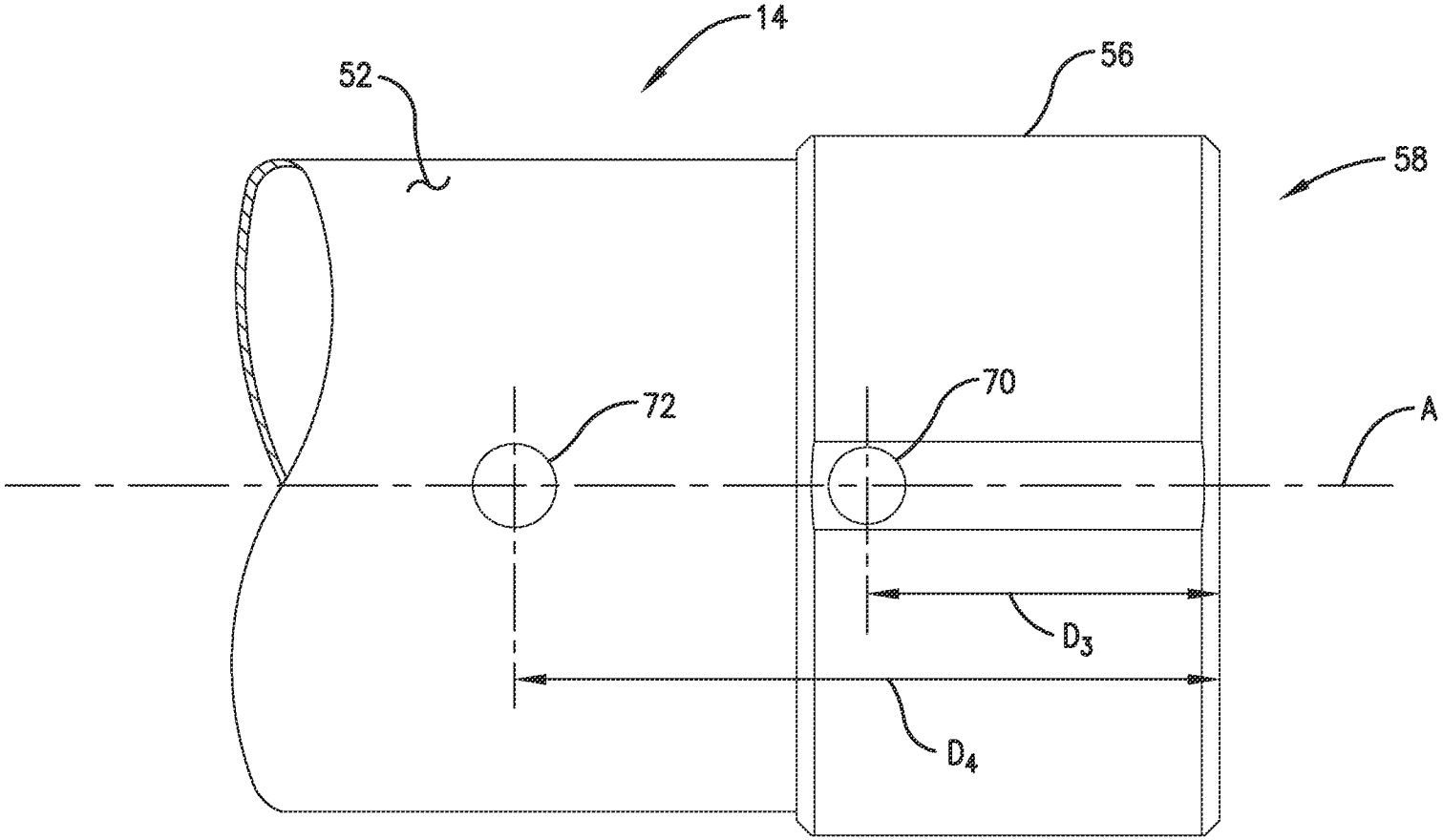
FIG. 8 is an enlarged bottom view of a collar portion of the outer tube shown in FIG. 5.

FIG. 5 is a perspective view of the outer tube 14; FIG. 6 is a sectional view of the outer tube 14, taken along the longitudinal axis of the outer tube, as shown in FIG. 5; FIG. 7 is a top view of the outer tube 14; and FIG. 8 is an enlarged bottom view of the collar portion 56 of the outer tube 14. Referring to FIGS. 5-8, the outer tube 14 is generally an elongated circular shaped tube defining a central axis "A" and having an integral collar portion 56 formed on a distal tube end 58 of the outer tube 14. In the exemplary embodiment, the outer tube 14 is fabricated as a unitary component. However, in other aspects of the present invention, the outer tube 14 may be fabricated as two or more connected components.

The outer tube 14 includes a generally constant wall thickness $T_1$ of its sidewall 52 and is therefore hollow, defining an interior chamber 54 therein. That is, the wall thickness $T_1$ is substantially the same at any portion along the outer tube 14, except as may be noted herein, such as at the collar portion 56. In the exemplary embodiment, the wall thickness $T_1$ is in the range between and including about forty thousandths of an inch (0.040") to about sixty thousandths of an inch (0.060"). However, in other aspects of the present invention, the wall thickness $T_1$ may be any alternative wall thickness that enables the outer tube 14 to function as described herein.

The outer tube 14 presents an open proximal tube end 60 and the open distal tube end 58. In the exemplary embodiment, the outer tube 14 has a substantially circular cross section along its length in a plane that is substantially perpendicular to the central axis "A." However, in other aspects of the present invention, the outer tube 14 may have any cross-sectional shape that enables the outer tube 14 to function as described herein, including, for example, rectangular, oval, polygonal, and the like.

In the exemplary embodiment, the outer tube 14 has a generally constant outer diameter, labelled in FIG. 7 by reference number 62, along a length $L_1$, which extends from the distal tube end 58 to the collar portion 56. The collar portion extends a length $L_2$ and has a generally constant outer diameter, labelled in FIG. 7 by reference number 64. In the exemplary embodiment, the diameter 62 is in the range between and including about one and eight tenths of an inch (1.8") and about one and nine tenths of an inch (1.9"). The diameter 64 is in the range between and including about one and ninety-five hundredths of an inch (1.95") and about two and five tenths of an inch (2.05"). Furthermore, length $L_1$ is in the range between and including about nineteen inches (19") and about nineteen and two tenths of an inch (19.2"). The collar portion length $L_2$ is in the range between and including about one and one tenth of an inch (1.1") and about one and three tenths of an inch (1.3").

In the exemplary embodiment, the outer tube 14 includes an opening 50 disposed therein. The opening 50 has a predetermined size for enabling passage of objects and/or materials therethrough. In the exemplary embodiment, the opening 50 is generally centered on the central axis "A." The shape of the opening 50 is generally defined by two (2) semi-circular arcs connected by a pair of tangential edges. The first arc 66 has a radius $R_1$ and the second arc 68 has a radius $R_2$, which is larger than the radius $R_1$. The first measure of the first and second arcs are determined, in part, based on the size, shape, and/or type of objects or material to be deposited therethrough, as described herein. The center point of the first arc 66 is positioned a distance $D_1$ from the distal tube end 58. The center point of the second arc 68 is positioned a distance $D_2$ from the center point of the first arc 66. As with the measure of the arcs, the distance $D_2$ is determined, in part, based on the size, shape, and/or type of objects or material to be deposited through the opening 50.

As shown in FIG. 8, the outer tube 14 includes a pin hole 70 and a plunger hole 72 defined through the sidewall 52 of the tube. Each of the pin hole 70 and plunger hole 72 is generally centered on the central axis "A." The pin hole 70 is located a distance $D_3$ from the distal tube end 58 and is sized to form an interference fit with the anti-rotation pin 40 (see FIG. 3). As used herein, the phrase "interference fit" means a value of tightness between the outer peripheral surface of the anti-rotation pin 40 and the pin hole 70, i.e., an amount of radial clearance between the two components. A negative amount of clearance is also commonly referred to as a press fit, where the magnitude of interference determines whether the fit is a light interference fit or an interference fit. In the exemplary embodiment, the distance $D_3$ is in the range between and including about nine tenths of an inch (0.9") and about one and one tenth of an inch (1.1"). The diameter of the pin hole 70 is sized to provide an interference fit, as described above, with a standard 7⁄32" dowel pin. It is noted that, in other embodiments, the distance $D_3$ and diameter of the pin hole 70 can be any measure that enables the outer tube 14 to function as described herein.

The plunger hole 72 is located a distance $D_4$ from the distal tube end 58 and is sized to form loose or sliding fit with the nose of the spring plunger assembly 42. A small amount of positive clearance (e.g., between the spring plunger noise and the plunger hole 72) is referred to as a loose or sliding fit. In the exemplary embodiment, the distance $D_4$ is in the range between and including about one and nine tenths of an inch (1.9") and about two and one tenth of an inch (2.1"). It is noted that, in other embodiments, the distance $D_4$ and diameter of the plunger hole 72 can be any measure that enables the outer tube 14 to function as described herein.

As shown in FIGS. 1-6, the outer tube 14 includes a plurality of threaded holes 74 extending radially through the collar portion 56. In particular, the figures depict two (2) threaded holes 74, opposite each other, and rotationally positioned about ninety degrees (90°) about the central axis "A" relative to the pin hole 70 and a plunger hole 72. The threaded holes 74 are configured to receive, for example, a threaded fastener or pin configured to secure the inner tube 16 in position relative to the outer tube 14.

Figure 9:
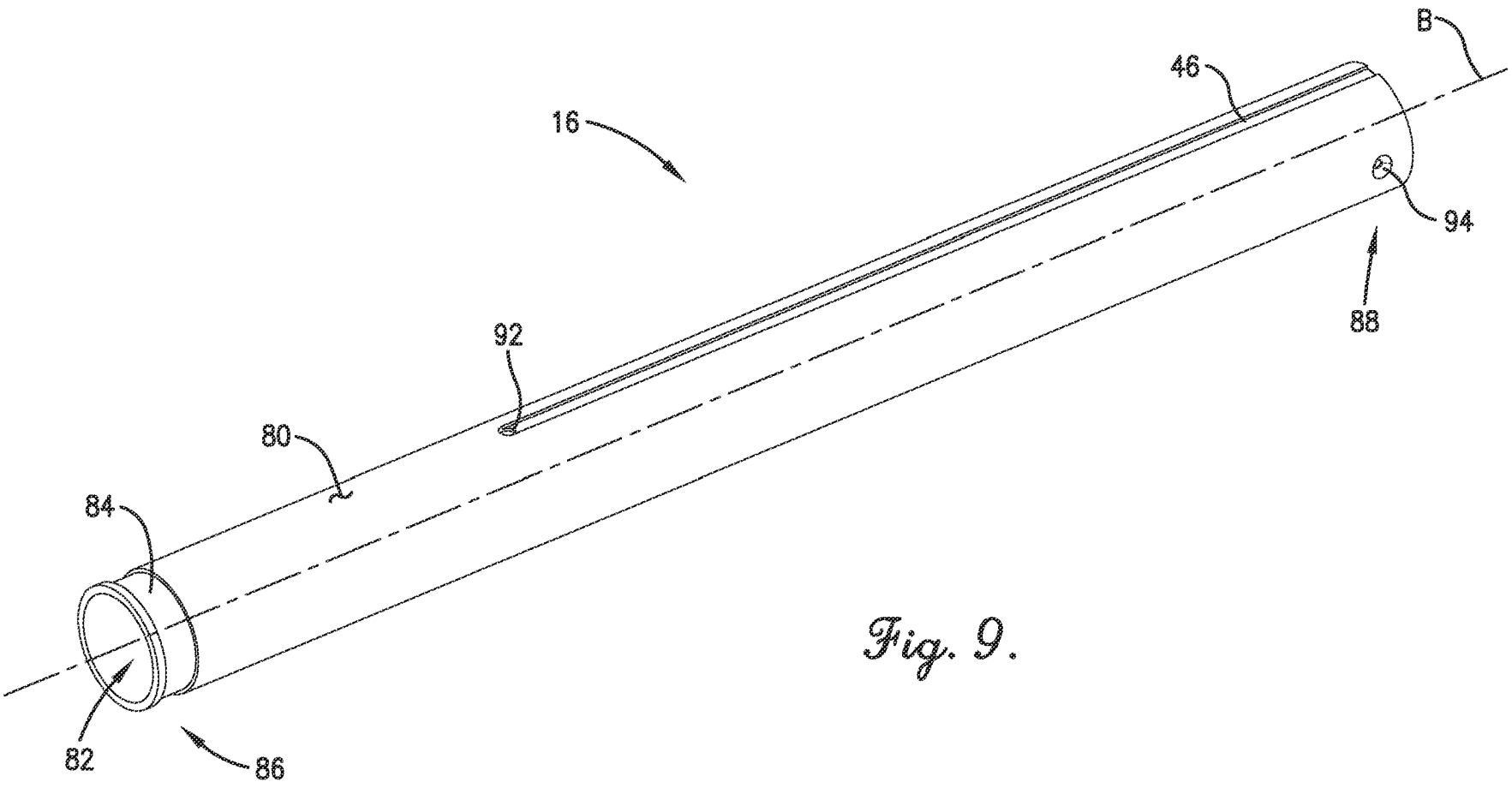
FIG. 9 is a perspective view of an inner tube of the apparatus shown in FIG. 1.
Figure 10:
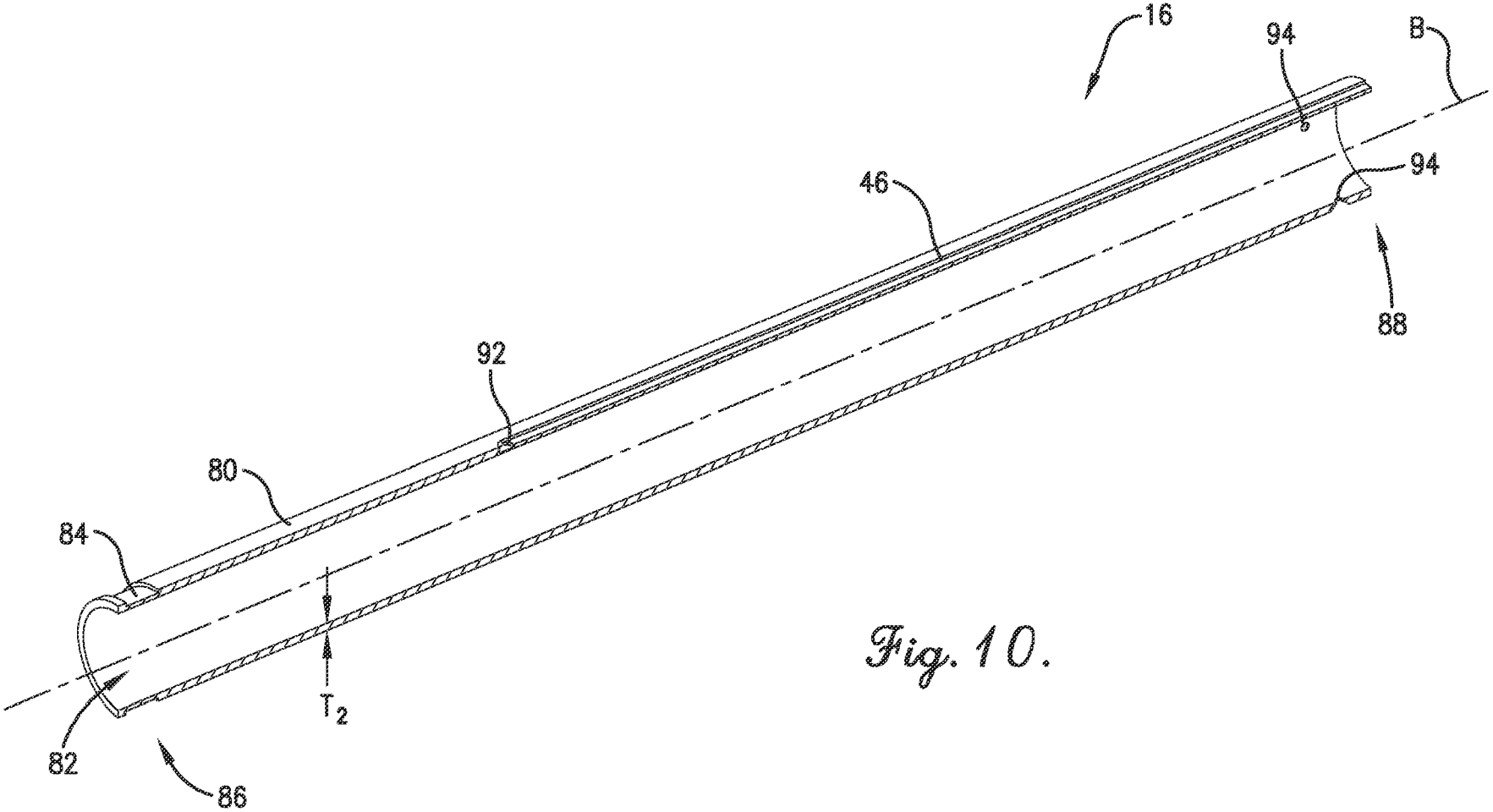
FIG. 10 is a sectional view of the inner tube shown in FIG. 9, taken along the longitudinal axis of the inner tube, as shown in FIG. 9.
Figure 11:
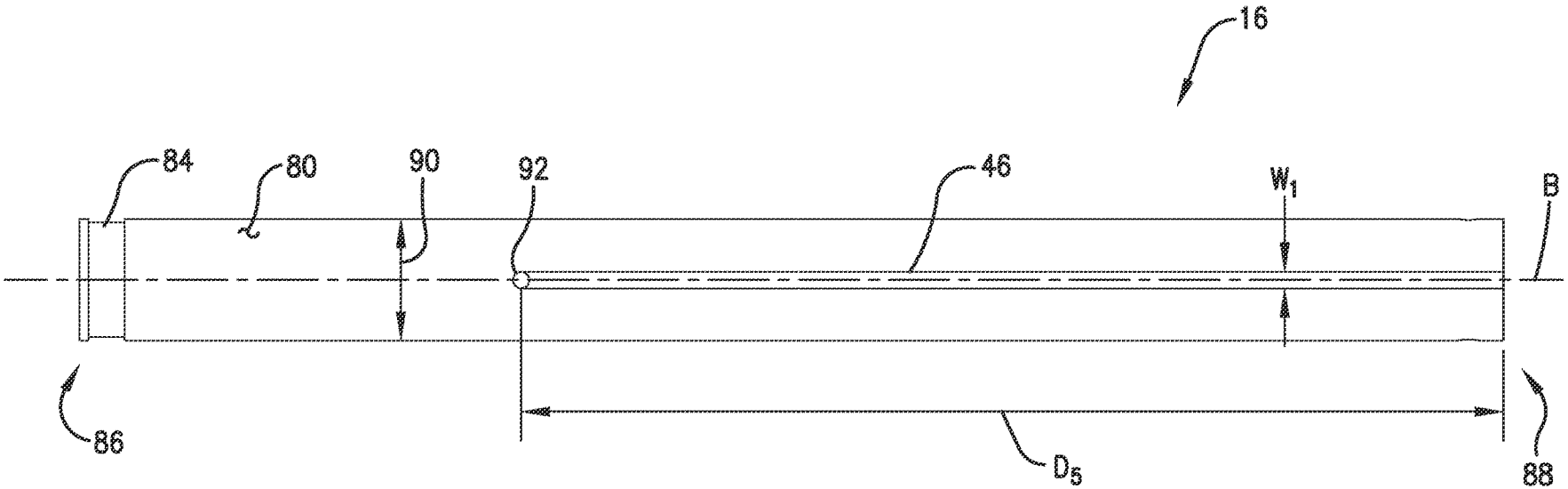
FIG. 11 is a top view of the inner tube shown in FIG. 9.

FIG. 9 is a perspective view of the inner tube 16; FIG. 10 is a sectional view of the inner tube 16, taken along the longitudinal axis of the inner tube, as shown in FIG. 9; and FIG. 11 is a top view of the inner tube 16. Referring to FIGS. 9-11, the inner tube 16 is generally an elongated circular shaped tube defining a central axis "B." The inner tube 16 includes a generally constant wall thickness $T_2$ of its sidewall 80 and is therefore hollow, defining a chamber 82 therein. That is, the wall thickness $T_2$ is substantially the same at any portion along the inner tube 16, except as may be noted herein, such as at a seal groove 84. In the exemplary embodiment, the wall thickness $T_2$ is in the range between and including about one hundred and five thousandths of an inch (0.105") to about one hundred and twenty-five thousandths of an inch (0.125"). However, in other aspects of the present invention, the wall thickness $T_2$ may be any alternative wall thickness that enables the inner tube 16 to function as described herein.

The inner tube 16 presents an open proximal tube end 86 and an open distal tube end 88. In the exemplary embodiment, the inner tube 16 has a substantially circular cross section along its length in a plane that is substantially perpendicular to the central axis "B." However, in other aspects of the present invention, the inner tube 16 may have any cross-sectional shape that enables the inner tube 16 to function as described herein, including, for example, rectangular, oval, polygonal, and the like. It is noted that the cross sections of the inner and outer tubes 16, 14 are substantially the same shape to facilitate telescopic engagement with one another, as described above.

In the exemplary embodiment, the inner tube 16 has a generally constant outer diameter, labelled in FIG. 11 by reference number 90, along a length $L_3$. In the exemplary embodiment, the outer tube diameter 90 is in the range between and including about one and seventy tenths of an inch (1.70") and about one and seventy-five tenths of an inch (1.75"). Furthermore, the length $L_3$ is in the range between and including about twenty inches (20") and about twenty and five tenths of an inch (20.5").

In the exemplary embodiment, the inner tube 16 includes the seal groove 84 formed therein adjacent the proximal tube end 86. The seal groove 84 is formed as a continuous annular groove having a depth in the sidewall 80 that is in the range between and including about fifty thousandths of an inch (0.050") of about fifty-five thousandths of an inch (0.055"). The seal groove 90 has an axial width in the range between and including about five tenths of an inch (0.5") and about fifty-five hundredths of an inch (0.55").

As described above, the inner tube 16 includes the groove 46. The groove 46 is substantially centered about the central axis "B." The groove 46 has a width $W_1$ sized and shaped to receive the nose of the spring plunger assembly 42. In the exemplary embodiment, the width $W_1$ is in the range between and including about two hundred and thirty-five thousandths of an inch (0.235") and about two hundred and forty thousandths of an inch (0.240"). The groove 46 is formed in the sidewall 80 at a depth between and including about fifty thousandths of an inch (0.050") and about sixty thousandths of an inch (0.060"). It is noted that, in other embodiments, the width and depth can be any measure that enables the inner tube 16 to function as described herein.

As depicted in FIG. 11, the groove 46 extends a distance $D_5$ from the distal tube end 88 and terminates at a circular pocket 92. The circular pocket 92 has a diameter that is substantially equal to the width $W_1$ of the groove 46. The circular pocket 92 is formed in the sidewall 80 at a depth between and including about ninety thousandths of an inch (0.090") and about one hundred thousandths of an inch (0.100"). As described herein, the circular pocket 92 is configured to receive the nose of the spring plunger assembly 42 therein when the shrouded screw apparatus 10 is in the expanded configuration depicted in FIG. 16. In the exemplary embodiment, the distance $D_5$ is in the range between and including about thirteen and nine tenths of an inch (13.9") and about fourteen and one tenth of an inch (14.1"). It is noted that, in other embodiments, the distance $D_5$ can be any measure that enables the inner tube 16 to function as described herein.

As shown in FIGS. 2, 3, 9, and 10, the inner tube 16 includes a plurality of countersink holes 94 extending radially through the sidewall 80. In particular, the figures depict three (3) countersink holes 94 rotationally positioned about ninety degrees (90°) apart about the central axis "B" relative to the groove 46. The countersink holes 94 are configured to receive, for example, a threaded fastener configured to secure the bearing cap 28 to the distal tube end 88 of the inner tube 16, as shown in FIGS. 2 and 3.

In the exemplary embodiment, the outer and inner tubes 14, 16 are fabricated from a metal material, such as an aluminum alloy. It is contemplated, however, that the outer and inner tubes 14, 16 may be fabricated from any generally rigid material that enables the shrouded screw apparatus 10 to function as described herein. For example, and without limitation, the outer and inner tubes 14, 16 may be fabricated from a suitably selected plastic material, such as, polyethylene, polypropylene, polyvinyl chloride, and the like.

Figure 12:
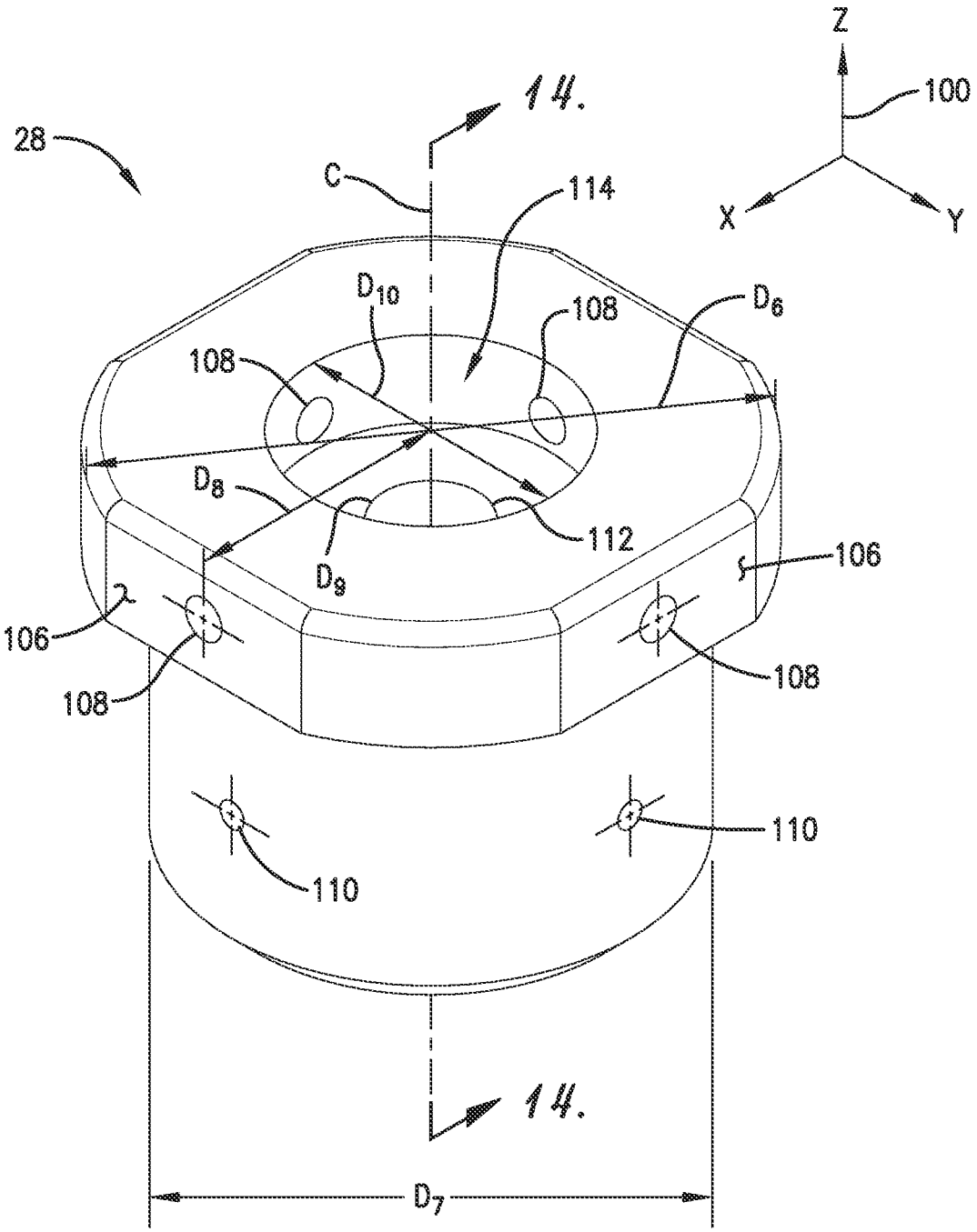
FIG. 12 is a perspective view of a bearing cap of the apparatus shown in FIG. 1, looking downward toward the top of the cap.
Figure 13:
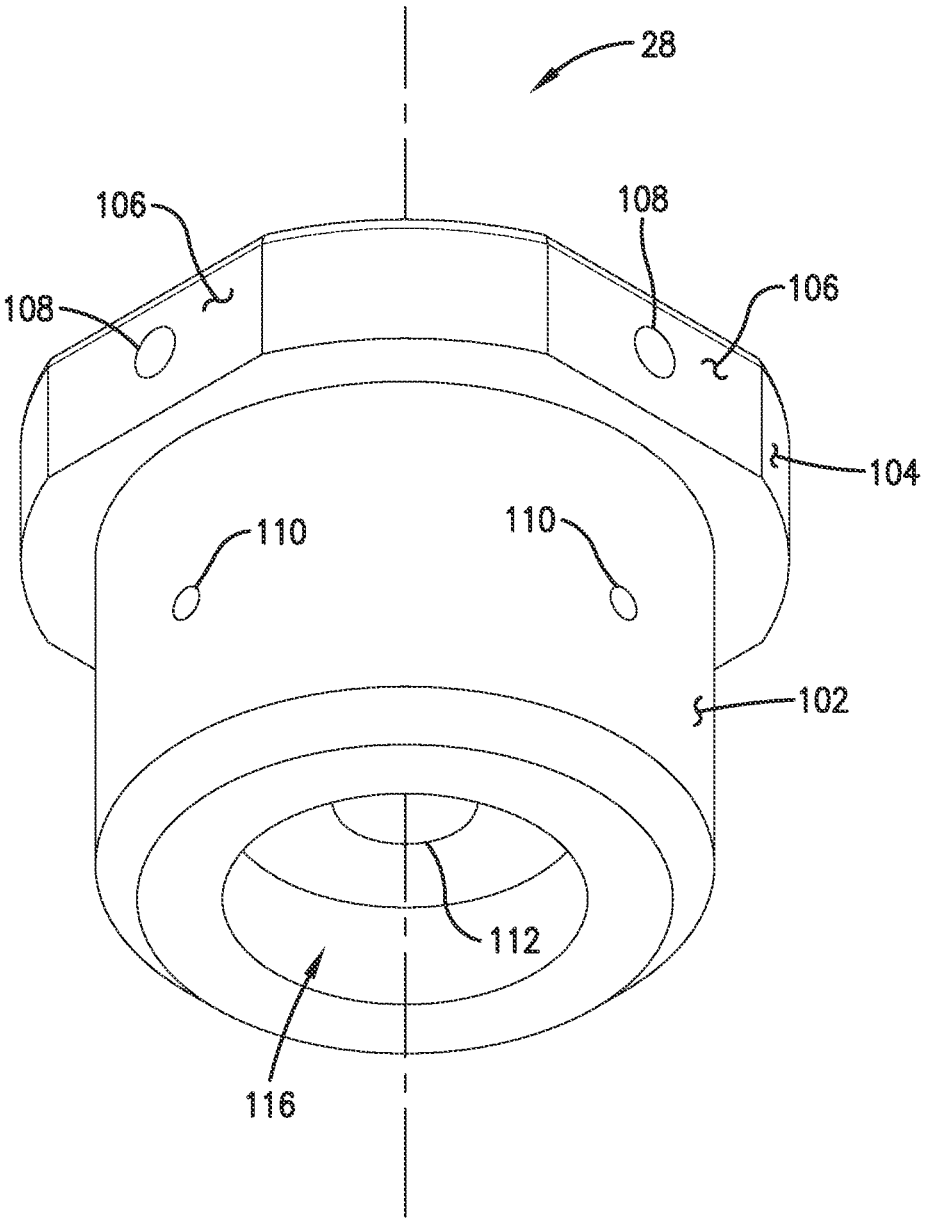
FIG. 13 is a perspective view of the bearing cap shown in FIG. 12, looking upward toward the bottom of the cap.
Figure 14:
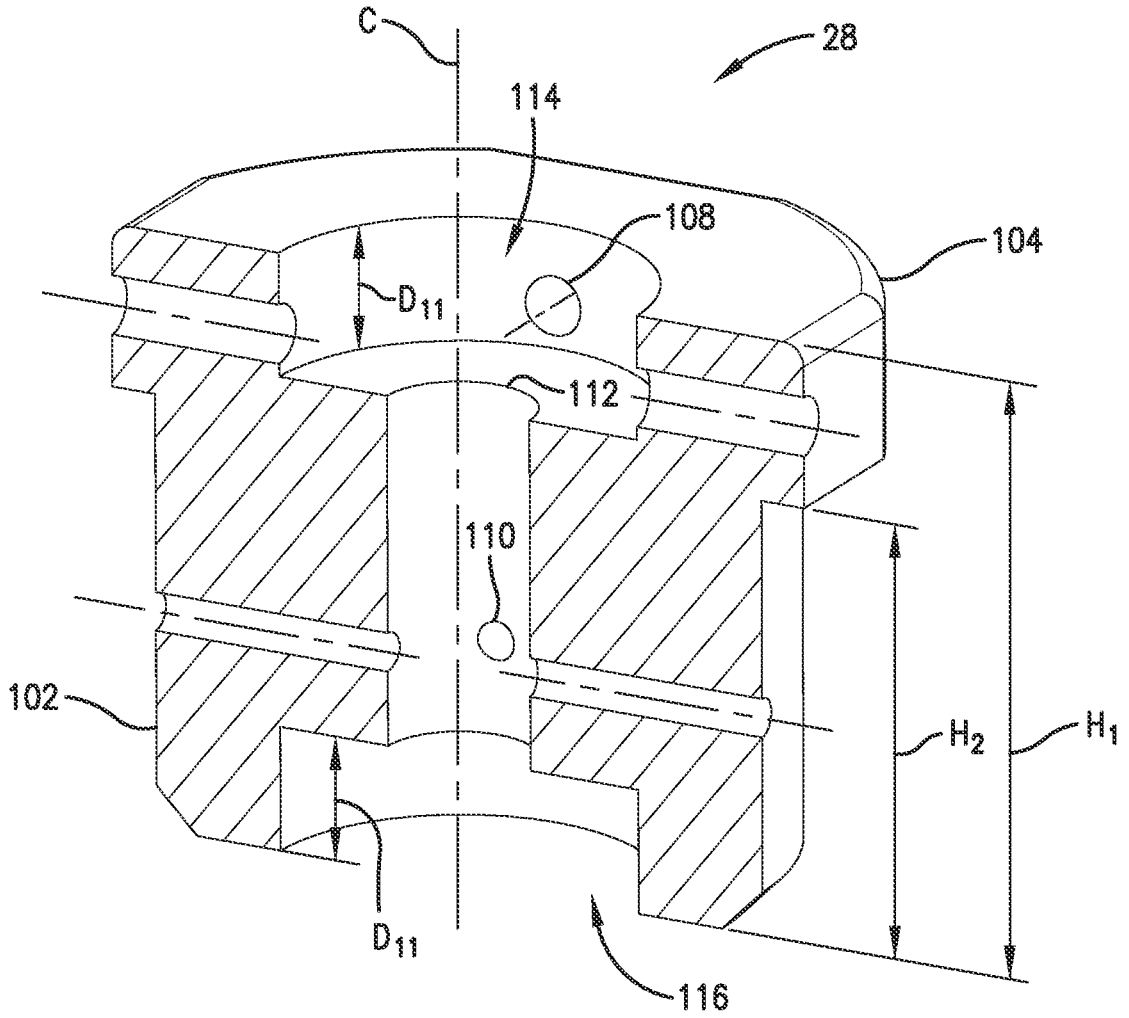
FIG. 14 is a sectional view of the bearing cap shown in FIG. 12, taken along the central axis (line 14-14) shown in FIG. 12.

FIG. 12 is a perspective view of the bearing cap 28, looking downward toward the top of the cap; FIG. 13 is a perspective view of the bearing cap 28, looking upward toward the bottom of the cap; and FIG. 14 is a sectional view of the bearing cap 28, taken along the central axis (line 14-14) shown in FIG. 12. To facilitate the discussion of the bearing cap 28, a coordinate system 100 is shown with an x-axis, y-axis, and z-axis, each axis orthogonal to the other two axes.

In the exemplary embodiment, the bearing cap is generally formed as a cylindrical component, defining a central axis "C." It should be noted that the bearing cap 28 has ninety degree (90°) rotational symmetry about the central axis "C." That is, with respect to the illustrated coordinate system 100, the bearing cap 28 is substantially symmetrical about the x-z plane and the y-z plane.

The bearing cap 28 includes an upper shoulder 104 adjacent an end of a body portion 102. The shoulder 104 has a general outside diameter of $D_6$, which is sized to engage the distal tube end 58 of the outer tube 14 when the bearing cap 28 is coupled to the inner tube 16. In this manner, the inner tube 16 is prevented from passing entirely through the outer tube 14. In the exemplary embodiment, the diameter $D_6$ is in the range between and including about one and eight tenths of an inch (1.8") and one and nine tenths of an inch (1.9"). The body portion 102 has a general outside diameter of $D_7$, which is sized to fit within the inner diameter of the inner tube 16. In the exemplary embodiment, the diameter $D_7$ is in the range between and including about one and four hundred and eighty-five thousandths of an inch (1.485") and one and four hundred and ninety-five thousandths of an inch (1.495"). It is noted that, in other embodiments, the diameters $D_6$ and $D_7$ can be any measure that enables the bearing cap to function as described herein.

The upper shoulder 104 includes a plurality of planar surfaces 106 defined thereon, each of which is substantially parallel to the central axis "C," having ninety degree (90°) rotational symmetry, as described above. The planar surfaces 106 are spaced radially outward from the central axis a distance $D_8$, which in the exemplary embodiment, is in a range between and including about eighty-four hundredths of an inch (0.84") and about eighty-six hundredths of an inch (0.86"). In other embodiments, the distance $D_8$ can be any measure that enables the bearing cap to function as described herein.

The bearing cap further includes a first set of threaded holes 108, wherein each planar surface 106 includes a respective threaded hole 108 located thereon. The threaded holes 108 are substantially centered on the planar surface 106 and extend radially through the bearing cap 28 to the central axis "C." Furthermore, the bearing cap includes a second set of threaded holes 110 formed through the body portion 102. Each of the threaded holes 110 extend radially through the bearing cap 28 to the central axis "C" and are positioned to align with the countersink holes 94 of the inner tube 16. In this manner, the bearing cap 28 can be secured to the inner tube 16, with the upper shoulder 104 resting adjacent the distal tube end 88.

The bearing cap 28 includes a center bore 112 extending entirely through the bearing cap 28, concentric with the central axis "C." The center bore 112 is configured to enable the shaft 26 of the auger bit 22 to pass therethrough. In the exemplary embodiment, the center bore 112 has a diameter $D_9$ in the range between and including about three hundred and twenty-five thousandths of an inch "0.325") and about three hundred and seventy-five thousandths of an inch (0.375"). However, it is noted that in other embodiments, the diameter of the center bore 112 can be any measure that enables the bearing cap 28 to function as described herein.

The bearing cap 28 also includes and upper bearing pocket 114 sized to receive the outer bearing 32, and a substantially identically sized lower bearing pocket 116 sized to receive the inner bearing 30. The bearing pockets 114, 116 have a diameter $D_{10}$, which is sized to provide an interference fit with the bearings 30, 32. In addition, each bearing pocket 114, 116 is formed at a depth $D_{11}$.

Figure 15:
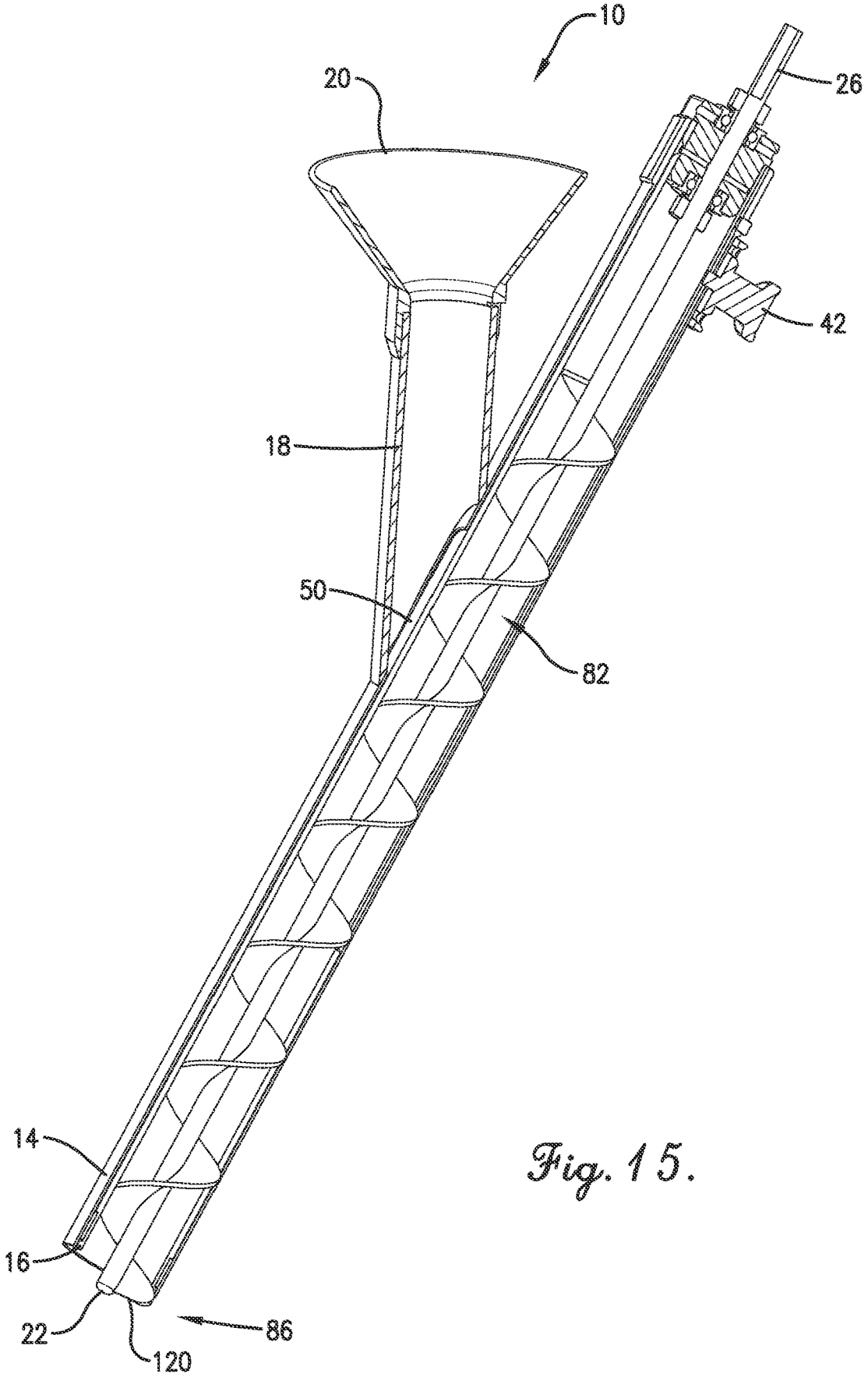
FIG. 15 is a section view of the shrouded screw apparatus of FIG. 1, illustrated in a contracted configuration.
Figure 16:
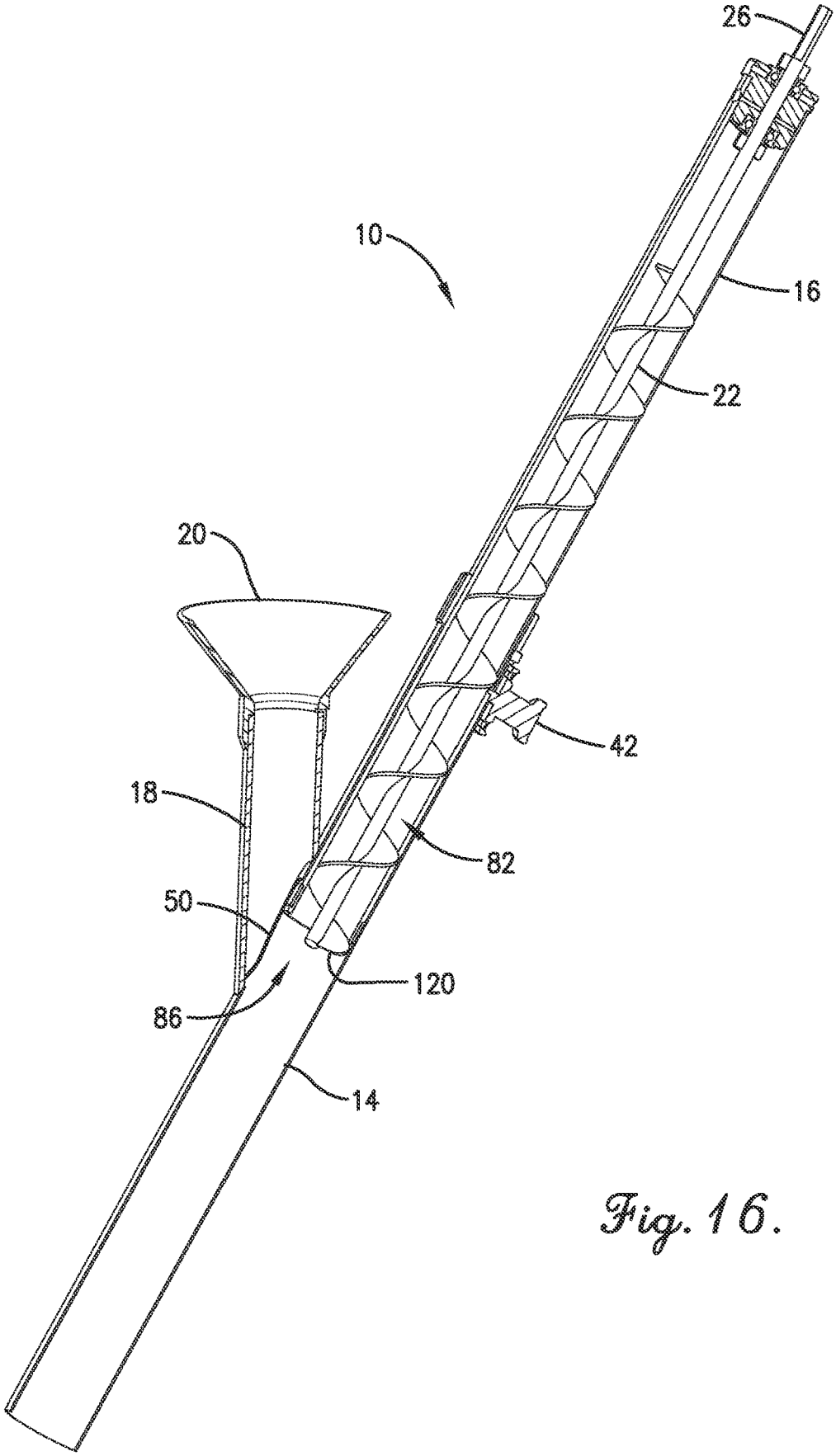
FIG. 16 is a section view of the shrouded screw apparatus of FIG. 1, illustrated in an expanded configuration.

FIG. 15 is a section view of the shrouded screw apparatus 10 in the contracted configuration, and FIG. 16 is a section view of the shrouded screw apparatus 10 in the expanded configuration. A method for implanting an object into a material, such as soil, will be described with reference to FIGS. 15 and 16. It is noted that the material may include materials and substrates other than soil (e.g., sand, silt, clay, loam, powder, etc.).

In operation, a user (not shown) adjusts the position of the auger bit 22 relative to the inner tube 16 based, in part, on the material or substrate in which the shrouded screw apparatus 10 is to be used. In particular, the user positions the inner shaft collar 34 along the shaft 26 of the auger bit 22 to locate a cutting tip 120 of the auger bit 22 relative to the open proximal tube end 86 of the inner tube 16. For example, for use in substrate materials that are loose (e.g., sand, powder, etc.), the cutting tip 120 of the auger bit 22 may be located adjacent the open proximal tube end 86 or slightly within the inner tube 16. For denser substrate materials (e.g., clay), the cutting tip 120 of the auger bit 22 extends beyond the open proximal tube end 86 of the inner tube 16 (see FIG. 1).

After the inner shaft collar 34 is positioned and tightened in place, the user inserts the auger bit 22 into the inner tube 16, passing the shaft 26 through the bearings 30, 32 until the inner shaft collar 34 contacts the bearing 30. The user then attaches the outer shaft collar 36 to the shaft 26, being sure to locate the outer shaft collar 36 against the bearing 32. In this manner, the inner and outer shaft collars 34, 36 locate and secure the auger bit to the inner tube 16 (via the bearing cap 28).

The user then attaches a torque producing means 12 (shown in FIG. 1) to the shaft 26 of the auger bit 22. The torque producing means includes, for example, a drill (e.g., electricity, battery, air, or manual power), a hand crank, a wrench (e.g., fixed size, adjustable, ratchet, socket, etc.), a torque driver (e.g., a hex driver, etc.), and the like. The user places the shrouded screw apparatus 10 at a position for the bore hole, where the cutting tip 120 of the auger bit 22 is set against the substrate material (e.g., soil).

The user activates the torque producing means 12 to rotate the auger bit 22 in a clockwise direction to draw material into the chamber 82 of the inner tube 16. It is noted that the auger bit 22 may have flights in a helical pattern that requires counterclockwise rotation to draw material into the chamber 82, and as such, the torque producing means 12 may be activated to rotate the auger bit in a counterclockwise direction. As the auger bit 22 drills into the material, it draws the shrouded screw apparatus 10 downward into the material until a predetermined depth is reached. The extracted material is encased within the chamber 82 of the inner tube 16, where the flight(s) 24 facilitate keeping the extracted material contained therein.

After the predetermined depth is reached, the user deactivates the torque producing means 12 to stop to rotation of the auger bit 22. The user pulls upward on the inner tube 16 causing the inner tube 16 to slide (extend) upward telescopically relative to the outer tube 14, such that the inner tube 16 is configured to extend from and retract within the interior chamber 54 of the outer tube 14. In this manner, the outer tube 14 is positioned within the bore hole in the substrate material. The inner tube 16 is drawn upward until the spring plunger engages the circular pocket 92 to lock the inner tube in the expanded configuration shown in FIG. 16.

As illustrated in FIG. 16, in the expanded configuration, the distal tube end 88 of the inner tube 16 is extracted upward past at least a portion of the opening 50 in the outer tube 14. As such, the user may deposit one or more objects or materials into the funnel 20 and/or the depositing tube 18. The objects or materials fall through the opening 50 and into the bore hole formed by the auger bit 22. After depositing the objects or materials into the bore hole, the user reverses the rotation direction of the torque producing means 12 to discharge the extracted material back into the bore hole from the chamber 82. The user disengages the spring plunger 42 from the circular pocket 92, for example, by pulling the spring plunger radially outward from the outer tube 14. This allows the inner tube 16 to contracted inward to the contracted configuration (see, e.g., FIGS. 1 and 15).

In certain embodiments, the shrouded screw apparatus 10 may be used with materials that could cause the buildup of a static charge. To prevent electrostatic discharge (ESD), one or more grounding lugs (not shown) may be attached to the threaded holes 108 of the bearing cap 28. The grounding lugs facilitate electrically grounding the bearings 30, 32 and auger bit 22.

Advantageously, embodiments of the present invention provides for the rapid, deep implantation of large quantities of material or large objects within densely packed material. Capturing the removed or extracted material with the ability to immediately redeposit it into the bore hole after implanting an object or other material increase efficiency and reduces costs.

Although the above description presents features of preferred embodiments of the present invention, other preferred embodiments may also be created in keeping with the principles of the invention. Such other preferred embodiments may, for instance, be provided with features drawn from one or more of the embodiments described above. Yet further, such other preferred embodiments may include features from multiple embodiments described above, particularly where such features are compatible for use together despite having been presented independently as part of separate embodiments in the above description.

Those of ordinary skill in the art will appreciate that any suitable combination of the previously described embodiments may be made without departing from the spirit of the present invention.

The preferred forms of the invention described above are to be used as illustration only and should not be utilized in a limiting sense in interpreting the scope of the present invention. Obvious modifications to the exemplary embodiments, as hereinabove set forth, could be readily made by those skilled in the art without departing from the spirit of the present invention.

The invention claimed is:

1. An apparatus comprising:

an outer tube having a first sidewall defining a first interior chamber, the first sidewall having an opening defined therethrough;

an inner tube positioned in the first interior chamber, the inner tube having a second sidewall defining a second interior chamber, the second sidewall having a longitudinal groove defined therein, wherein the inner tube is configured to extend from and retract within the first interior chamber of the outer tube;

an auger bit positioned in the second interior chamber, the auger bit rotatably coupled to the inner tube; and an anti-rotation pin coupled to the first sidewall of the outer tube, the anti-rotation pin extending inwardly into the first interior chamber and engaging the longitudinal groove of the inner tube, such that as the inner tube extends from and retracts within the first interior chamber, the inner tube is prevented from rotating with respect to the outer tube.

2. The apparatus in accordance with claim 1, further comprising:

a depositing tube having a proximal end coupled to the outer tube; and a receiving funnel coupled to a distal end of the depositing tube, wherein the depositing tube defines a hollow cylindrical body aligned with the opening.

3. The apparatus in accordance with claim 2, wherein a centerline of the depositing tube intersects a centerline of the outer tube at a non-zero degree angle.

4. The apparatus in accordance with claim 3, wherein the angle is in a range between and including twenty degrees (20°) and forty degrees (40°).

5. The apparatus in accordance with claim 1, further comprising a spring plunger assembly coupled to the outer tube, the spring plunger assembly extending inwardly into the first interior chamber and engaging the longitudinal groove of the inner tube, the longitudinal groove of the inner tube further comprising a circular pocket located at a terminus of the longitudinal groove, wherein as the inner tube extends from the first interior chamber, the spring plunger assembly engages the circular pocket to lock the inner tube in an expanded configuration.

6. The apparatus in accordance with claim 1, further comprising a bearing cap coupled to the inner tube, wherein the auger bit being rotatably coupled to the inner tube comprises the auger bit being rotatably coupled to the bearing cap.

7. The apparatus in accordance with claim 6, the bearing cap comprising an inner bearing and an outer bearing fixedly coupled thereto, the auger bit comprising a shaft coupled to the inner and outer bearings for rotation relative to the inner tube.

8. The apparatus in accordance with claim 7, wherein the inner and outer bearings comprise one or more of the following: a ball bearing, a roller bearing, and a sleeve bearing.

9. The apparatus in accordance with claim 6, the bearing cap comprising an upper shoulder sized to engage a distal tube end of the outer tube.

10. The apparatus in accordance with claim 6, the bearing cap comprising an upper bearing pocket receiving an outer bearing, and an identically sized lower bearing pocket receiving an inner bearing.

11. The apparatus in accordance with claim 1, further comprising a seal coupled to the inner tube, wherein the seal is sized and shaped to engage the outer tube as the inner tube extends from and retracts within the first interior chamber of the outer tube.

12. The apparatus in accordance with claim 11, wherein the seal is fabricated from one or more of a textile material and a flexible resilient material.

13. The apparatus in accordance with claim 12, wherein the seal is fabricated from non-woven felt.

14. The apparatus in accordance with claim 1, wherein the auger bit comprises a helical flight extending axially along a shaft of the auger bit.

15. The apparatus in accordance with claim 14, wherein the auger bit is a single flight auger bit.

16. The apparatus in accordance with claim 1, wherein the auger bit comprises two or more helical flights extending axially along a shaft of the auger bit.

17. The apparatus in accordance with claim 1, further comprising a torque producing means coupled to the auger bit, the torque producing means configured to rotate the auger bit within the inner tube.

* * * * *